US009864948B2

(12) United States Patent
Glockseisen

(10) Patent No.: US 9,864,948 B2
(45) Date of Patent: Jan. 9, 2018

(54) HAND PLIERS

(71) Applicant: WEZAG GmbH Werkzeugfabrik, Stadtallendorf (DE)

(72) Inventor: Thomas Glockseisen, Düsseldorf (DE)

(73) Assignee: WEZAG GMBH WERKZEUGFABRIK, Stadtallendorf (DE)

( * ) Notice: Subject to any disclaimer, the term of this patent is extended or adjusted under 35 U.S.C. 154(b) by 272 days.

(21) Appl. No.: 14/851,230

(22) Filed: Sep. 11, 2015

(65) Prior Publication Data

US 2016/0078338 A1 Mar. 17, 2016

(30) Foreign Application Priority Data

Sep. 11, 2014 (EP) ..... 14184375

(51) Int. Cl.

| | |
|---|---|
| ***B25B 7/00*** | (2006.01) |
| ***H01R 43/042*** | (2006.01) |
| ***G06M 3/06*** | (2006.01) |
| ***B25B 27/14*** | (2006.01) |
| ***H01R 43/048*** | (2006.01) |
| ***G06M 3/02*** | (2006.01) |
| ***G07C 3/14*** | (2006.01) |

(52) U.S. Cl.

CPC ..... *G06M 3/06* (2013.01); *B25B 7/00* (2013.01); *B25B 27/146* (2013.01); *G06M 3/02* (2013.01); *G07C 3/14* (2013.01); *H01R 43/0486* (2013.01); *H01R 43/0421* (2013.01)

(58) Field of Classification Search

CPC ..... B25B 7/00; B25B 27/146; H01R 43/0421; G06M 3/02; G06M 3/06; G07C 3/14

See application file for complete search history.

(56) References Cited

U.S. PATENT DOCUMENTS 2,006,396 A 5/1933 Jorgenson
3,212,315 A 10/1965 Lee
(Continued)

FOREIGN PATENT DOCUMENTS

DE 1490170 12/1968
DE 2316769 10/1974
(Continued)

OTHER PUBLICATIONS

WEZAG Brochure, Innovation and Prazision, Made in Germany, Tools for Professional Application, Cat. 10/11, 35 pages.

*Primary Examiner* — Patrick O'Neill
(74) *Attorney, Agent, or Firm* — Thomas | Horstemeyer, LLP

(57) ABSTRACT

The invention relates to hand pliers (1) which are in particular embodied as crimping pliers. According to the invention, the hand pliers (1) comprise a counting device (16) which counts the number passed working strokes (17). The counting device (16) is built with a sensor which senses the distance or displacement of two components moved relatively to each other over the working stroke (17), in particular the distance or displacement of hand levers (2, 3). If the count number registered by the counting device (16) exceeds a threshold value, it is possible to produce a display at a displaying device of the hand pliers (1) which indicates that an exchange of drive elements or an exchange of dies or a certification of the hand pliers is required.

17 Claims, 5 Drawing Sheets

(56) References Cited

U.S. PATENT DOCUMENTS

| | | | |
|---|---|---|---|
| 3,590,484 | A | 7/1971 | Walsh |
| 3,903,725 | A | 9/1975 | Rommel |
| 4,763,406 | A | 8/1988 | Rommel et al. |
| 4,794,780 | A | 1/1989 | Battenfeld |
| 4,892,015 | A | 1/1990 | Beetz et al. |
| 5,153,984 | A | 10/1992 | Beetz et al. |
| 5,187,968 | A | 2/1993 | Beetz et al. |
| 5,526,570 | A | 6/1996 | Beetz et al. |
| 5,913,933 | A | 6/1999 | Beetz et al. |
| 6,026,671 | A | 2/2000 | Battenfeld |
| 6,035,775 | A | 3/2000 | Nghiem |
| 6,053,025 | A | 4/2000 | Beetz et al. |
| 6,155,095 | A | 12/2000 | Beetz |
| 6,202,290 | B1 | 3/2001 | Kewitz et al. |
| 6,240,626 | B1 | 6/2001 | Nghiem |
| 6,286,358 | B1 | 9/2001 | Beetz et al. |
| 6,289,712 | B1 | 9/2001 | Beetz et al. |
| 6,474,130 | B2 | 11/2002 | Battenfeld |
| 6,612,147 | B2 | 9/2003 | Beetz et al. |
| 6,877,228 | B2 | 4/2005 | Beetz et al. |
| 6,910,363 | B2 | 6/2005 | Beetz et al. |
| 7,155,954 | B2 | 1/2007 | Battenfeld |
| 8,087,280 | B2 | 1/2012 | Battenfeld et al. |
| 8,113,031 | B2 | 2/2012 | Batttenfeld et al. |
| 8,127,589 | B2 | 3/2012 | Battenfeld |
| 8,161,789 | B2 | 4/2012 | Battenfeld et al. |
| 8,230,715 | B2 | 7/2012 | Battenfeld et al. |
| 8,245,560 | B2 | 8/2012 | Battenfeld et al. |
| 8,296,956 | B2 | 10/2012 | Battenfeld |
| 8,516,872 | B2 | 8/2013 | Battenfeld et al. |
| 8,601,856 | B2 | 12/2013 | Battenfeld |
| 8,613,210 | B2 * | 12/2013 | Wagner ..... B25B 27/146 72/20.1 |
| 9,410,875 | B2 * | 8/2016 | Wagner ..... B25B 27/10 |
| 2010/0242568 | A1 | 9/2010 | Battenfeld et al. |
| 2010/0293720 | A1 | 11/2010 | Zhang |
| 2014/0083149 | A1 | 3/2014 | Wagner et al. |
| 2015/0217429 | A1 | 8/2015 | Battenfeld |

FOREIGN PATENT DOCUMENTS

| | | |
|---|---|---|
| DE | 3708727 | 7/1988 |
| DE | 3733358 | 3/1989 |
| DE | 3512157 | 6/1989 |
| DE | 4023337 | 10/1991 |
| DE | 4039435 | 6/1992 |
| DE | 4026332 | 7/1992 |
| DE | 4303180 | 1/1994 |
| DE | 29620856 | 12/1996 |
| DE | 19709639 | 3/1997 |
| DE | 29703052 | 5/1997 |
| DE | 19610899 | 7/1997 |
| DE | 29712879 | 10/1997 |
| DE | 19753436 | 12/1997 |
| DE | 4427553 | 6/1998 |
| DE | 29803336 | 7/1998 |
| DE | 29806179 | 11/1998 |
| DE | 19802287 | 12/1998 |
| DE | 19713580 | 12/1999 |
| DE | 19832884 | 12/1999 |
| DE | 19807737 | 6/2000 |
| DE | 19963097 | 4/2001 |
| DE | 10140270 | 8/2001 |
| DE | 19834859 | 11/2001 |
| DE | 19924087 | 6/2002 |
| DE | 10056900 | 8/2002 |
| DE | 19924086 | 8/2002 |
| DE | 10132413 | 7/2003 |
| DE | 10242345 | 2/2004 |
| DE | 10346241 | 8/2004 |
| DE | 102005003617 | 6/2006 |
| DE | 102005003615 | 9/2006 |
| DE | 202008003703 | 6/2008 |
| DE | 102007038626 | 10/2008 |
| DE | 102008005472 | 2/2009 |
| DE | 102007050176 | 4/2009 |
| DE | 102008017366 | 10/2009 |
| DE | 102008003524 | 12/2009 |
| DE | 102008007303 | 12/2009 |
| DE | 102008012011 | 12/2009 |
| DE | 102007001235 | 6/2010 |
| DE | 102009001949 | 9/2010 |
| DE | 2562891 | 3/2012 |
| DE | 102011050718 | 12/2012 |
| DE | 102004009489 | 9/2013 |
| EP | 0471977 | 7/1991 |
| EP | 1724101 | 5/2005 |
| EP | 2305428 | 9/2009 |
| EP | 2463969 | 1/2011 |
| EP | 2672580 | 6/2012 |
| EP | 2672581 | 6/2012 |
| EP | 2672582 | 6/2012 |
| EP | 2672583 | 6/2012 |
| EP | 2672585 | 6/2013 |
| EP | 2826598 | 7/2013 |
| EP | 2672584 | 12/2013 |
| EP | 2905848 | 2/2014 |
| EP | 2 977 146 A1 | 1/2016 |
| JP | 2013-043282 | 3/2013 |

* cited by examiner

HAND PLIERS

CROSS REFERENCE TO RELATED APPLICATIONS

This application claims priority to co-pending European Patent Application No. EP 14 184 375.5 entitled "Handzange", filed Sep. 11, 2014.

FIELD OF THE INVENTION

The present invention relates to hand pliers which might be any pliers not actuated by an external force but actuated manually by a user. Here, the pliers might be actuated by a single hand operation or a two hand operation. In order to mention only some examples, the pliers might be embodied as cutting pliers, crimping pliers or pressing pliers (in particular crimping pliers for sealingly crimping tube connections), hole punch pliers and the like. In the following, for simplification of the specification in some parts reference is made to crimping pliers without the intention to therewith limit the invention to this type of hand pliers.

BACKGROUND OF THE INVENTION

According to the publication DE 10 2007 050 176 A1 the increasing complexity of cable looms, a strengthening of products liability regulations and increased requirements for warranties require a quality management with a monitoring of a crimping force when producing a crimped connection. It is proposed to equip crimping pliers with a force measuring device which is built by a piezo-electric force sensor or strain gauges. The force measuring device is located at the outside of a crimping plug or also within a crimping plug or in a crimping housing. The crimping pliers are further equipped with a transmitter which is located above the crimping plug at the crimping pliers head. The transmitter transmits a wireless crimping force signal which is received by an external receiving and evaluating device and which is then evaluated.

By operating elements it is possible to switch the transmitter on and off. Furthermore, by the operating elements it is possible to define the frequency of the transmitter. An energy source for the energy supply to the transmitter and the force measuring device which is built by an electrical battery or a reloadable accumulator is integrated into the transmitter. Furthermore, it is possible that the transmitter comprises an induction coil in which an outer magnet field is able to produce an inductive current for reloading the accumulator. It is also possible that the crimping pliers are equipped with a solar cell by which an alternative way for reloading the accumulator is provided. However, also a power supply to the force measuring device and the transmitter by a temporary cable connection is possible. The crimping pliers have a displaying device. The displaying device displays a crimping force, a transmitting frequency, an indication that there is a wireless connection, a loading state of the accumulator and the like. Here, the displaying device might be built as a LED- or LCD-device. Additionally, a displacement measuring system might be provided at the crimping pliers for sensing the working stroke of the crimping pliers. For avoiding damages it is possible that the crimping pliers comprise a latching device or a slipping clutch which limits the applicable crimping force to a predefined value. The receiving and evaluating device might e.g. be built by a customary personal computer with a bluetooth-receiver. Also a database might be used, wherein received signals are stored in order to reliably and permanently document the quality of the produced crimped connections.

The publication DE 298 06 179 U1 describes also measures for the documentation of the progression of a crimping force dependent on the crimping displacement. Here, both the crimping force as well as the crimping displacement are measured in the region of the bit of the pliers or in an intermediate part of a lever drive of the crimping pliers. An evaluating circuit can be provided at the crimping pliers with a suitable display for displaying information concerning the quality of the crimping process. It is possible that the crimping pliers comprise a data storage, wherein for different types of produced crimped connections (in particular different types of contact elements) force-displacement-progressions are stored. As an optical displaying device, a display basing on light-emitting diodes or a display basing upon liquid crystals might be used. Additionally, it is possible to output a signal via an acoustic displaying device. By different colors or tones of the displaying device it is possible to transmit different information concerning the quality of the produced crimping connection and of the crimping force-crimping displacement-progression. An optical interface or a cable-based interface or any possible interface transmitting via the air (which uses electromagnetic radiation in the visible, infrared or radiofrequency region) is used as an interface for a stationary processor, wherein it is also possible to use a bi-directional interface. An evaluation of the crimping force progression might be done by a comparison with a predetermined crimping force progression, in some cases under consideration of a given tolerance region. Furthermore, it is proposed to sense both the crimping force as well as the crimping displacement each by a force sensor. Here the crimping displacement is transformed by a spring which is biased over the crimping displacement into a force which is then sensed by the force sensor.

The publication DE 10 2004 009 489 B4 discloses the support of the setting process for the working stroke specific to the crimped workpiece by a sensoric registration and electronic processing of the position of the crimping plugs.

The publication DE 2 316 769 A describes a crimping machine not being of the generic type. In the crimping machine it is possible to read the number of executed working strokes from a counting mechanism. In the publication it is not further explained how the number of working strokes is sensed and for what purpose the counting mechanism displays the number of working strokes.

DE 297 03 052 U1 describes in a corresponding way a count storage for storing the number of executed crimping processes for a crimping machine not being of the generic type and having an electrical drive. A display of the number of the executed crimping processes is intended to alert the operator if a maintenance interval has been passed. When having executed the maintenance, the counter should again be reset with a subsequent restart of the counting procedure from the beginning.

The publication DE 10 2011 050 718 A1 proposes a method for monitoring the wear of pressing pliers or crimping pliers. The method is intended for detecting the different crimping forces and the different wear caused by the different forces during the crimping process of on the one hand smaller workpieces and on the other hand larger workpieces. For this purpose, the crimping pliers comprise an adjusting device for adjusting the distance between the crimping elements achieved with the complete closure of the crimping pliers. The adjusted distance is transferred to a microcontroller system of the crimping pliers. Furthermore, the signal of an end position switch located at abutting surfaces of the hand levers is transferred to the microcontroller system. The end position switch triggers a counting impulse if the hand levers are completely closed. A value for predicting the wear which is stored in a storage unit predicts a wear caused by one completely passed actuating stroke dependent on the distance defined by the adjusting device. Here, it is possible that the value for predicting the wear has been determined empirically or by tests, relies on experience or is stored as mathematical functions. The values for predicting wear are summed up with the passing of a plurality of closing strokes of the crimping pliers. If the sum of the values for predicting wear reaches a defined limit value, a demand for a calibration of the crimping pliers is provided at an output. This might be provided by a display present at the crimping pliers, an acoustic signal or a mechanical blocking device. The limit value might be defined by a standard to be met or might be defined by the manufacturer. It is possible that by means of the calibration the actual wear is determined which is then stored in the storage unit of the crimping pliers and which can be shown at the display which might also be connected with a display of a remaining usability in %. Subsequently, there might be a reset of the summed value of overall wear. Then the values for predicting wear are again summed up until another limit value is reached with a new demand for a calibration. If the overall lifetime has been reached, a warning might be displayed at the display or the crimping pliers are mechanically locked. Furthermore, it is possible that a sensor for sensing the crimping force is provided in order to suppress an empty actuation of the crimping pliers for which there is no wear of the crimping pliers.

The publication US 2010/0293720 A1 discloses crimping pliers, wherein a counting device is integrated into the end region of a hand lever facing away from the pliers head with an integration into a U-shaped recess of the hand lever. The counting device comprises a housing, a cover, a LCD-display, a reed-sensor and a controller. On a side facing away from the aforementioned hand lever, another hand lever carries a permanent magnet. The approaching of the permanent magnet at the reed-sensor when running through the closing stroke of the hand levers triggers a counting impulse.

The publication DE 1 490 170 A1 relates to a so called manual bead device (DE: "Handsickengerat") which does not build hand pliers but has a pistol-like design with a handle and an actuating lever being mounted for being pivoted to the handle and building the trigger of the pistol-like design. The actuation lever acts via a redirecting lever, an actuating stamp, a latching toothing and a cam drive upon an actuating lever for producing the bead, wherein the actuating lever is biased by a spring package. The counting of the number of the completed closing strokes is here done by use of a mechanical counting device.

The publication U.S. Pat. No. 3,590,484 A discloses punching pliers for deactivating tickets, wherein the punching pliers comprise a mechanical counting device.

The publication U.S. Pat. No. 2,006,396 A also discloses punching pliers for deactivating tickets comprising a mechanical counting device.

SUMMARY OF THE INVENTION

The monitoring of an actuating force of hand pliers (in particular a crimping force) or the monitoring of a crimping force-crimping displacement-progression might be advantageous with respect to the provision of a desired result of the processing of the workpiece by the hand pliers. However, here it is normally assumed that the hand pliers (in particular its drive mechanism and its dies) are in a perfect condition. If e.g. wear or abrasion of a die of the hand pliers has established or a play in a bearing of the drive mechanism has changed, the working result of the hand pliers might deviate from the desired result also if in some cases the predetermined crimping force progression has been provided. In order to avoid deteriorations of the working results of hand pliers, the hand pliers are subject to regular calibrations or inspections of its condition. It is also possible that (similar to a "technical control board inspection") a regular certification of the condition of the hand pliers might be provided which is intended for guaranteeing a high quality of the working result as being required for hand pliers for the tube pressing industry or hand pliers for crimping of connecting elements in the airspace industry. However, a disadvantage of regular certifications of this type is that the intervals of the certification do not necessarily correlate with the actual amount of use of the hand pliers. It is e.g. possible that hand pliers required a longer delivery period between the manufacturing date and the date of the first use at the consumer. It is e.g. also possible that the hand pliers have been stored at the consumer over a longer time period before its first use. In these cases, the regular first certification would be performed too early. Furthermore, the frequency of use of one and the same hand pliers at different consumers or also by different employees of one and the same consumer might differ so that the choice of the intervals for the certification according to the highest frequency of use would require overdue expenditure for certification or it would be required to determine intervals which are individual for different consumers or employees of one consumer in order to reduce overdue expenditure for certification.

With the novel hand pliers, it is possible to provide hand pliers with extended options with respect to the monitoring of the correct operation of the hand pliers.

According to the invention, it is proposed that hand pliers of the above specified type are equipped with a counting device by which it is possible to count the number of working strokes that have been passed by the hand pliers. The invention bases upon the surprising finding that the use of a counting device (which may be quite known for complex crimping machines with a drive actuated by an external force as an electrical drive) might also be possible for hand pliers which significantly differ from a crimping machine with respect to the constructive expenditure and the typical dimensions, the number of cycles and the drive. For crimping machines a sensing of the crimping force and in some cases also the counting of the number of working strokes is trivial because in the crimping machine a drive signal (e.g. the current of the drive aggregate) is already present which can be evaluated for the determination of the crimping force or the number of working strokes. This is not the case for hand pliers. According to the invention, the counting device of the hand pliers does not (only) base upon sensing a crimping force by an actuating force or crimping force or by the evaluation of the driving movement of a drive of a crimping machine, in particular the electrical power consumption and the control signal of an electrical drive. Instead, in the inventive hand pliers the counting device comprises a sensor which senses the distance of two components of the hand pliers which move relatively to each other during the working stroke. The sensor might e.g. sense the distance of hand levers, of pliers yaws or any components of the drive mechanism which perform a movement which correlates with the movement through the working stroke. Accordingly, for the invention there is not a force sensor used but a displacement sensor or distance sensor which has proven to be advantageous with respect to the integration into hand pliers, the design space requirements, the robustness, the costs and the reliability. Here, the sensor is able to sense the distance over the whole working stroke or only over a part of the working stroke, preferably in the starting region of the working stroke or in the end region of the working stroke. It is possible that the sensing, providing and/or processing of the signal which is provided by the sensor is done continuously, digitally or (in the way of a switch) in an binary mode.

Within the frame of the invention, any distance sensor might be used. The sensor might be built by a contact-based sensor or a contact-free sensor. A capacitive sensor, an inductive sensor, an eddy current sensor, a hall sensor, a reed-sensor or -switch, a magneto-resistive sensor, a magneto-strictive sensor, an optical laser, a confocal sensor, an interferometer-sensor, an ultrasound sensor and the like might e.g. be used, wherein the invention is not limited to the use of one of the aforementioned types of sensors.

The invention proposes to build the counting device with a module (or with two modules which are each associated with one hand lever). It is possible that a control unit, at least a line connection in the form of a cable, a board, a transmitter, a receiver, a displaying device, a battery or an accumulator and/or a port for a power supply and/or data transfer is integrated into the module of one of the modules. In a module of this type the aforementioned components might be cast to a kind of block with a suitable material, e.g. synthetic resin or any flowable, paste-like or hardening material. A module cast in this way might be stored or kept on stock as a half-finished product for the manufacturing process of the hand pliers. By a casting of the module sensitive wire connections or other components can be protected against mechanical damages, contaminations, humidity or impacts. It is also possible that the assembly of the module with other components of the hand pliers is simplified by providing that it is possible that the module as a whole is brought into interaction with the component at which the module is to be mounted or is introduced into a recess designated for the same and then fixed as a whole. Superfluous are in some cases several separate mountings for the control unit, the wire connections, the board, the transmitter, the receiver, the displaying device and/or the battery or the accumulator. In some cases, also a process for disassembling of the cast module as the whole is made easier and the exchange against a repair module or replacement module or a module of another type is simplified.

Generally, the counting device might be integrated into any component of the hand pliers. It is e.g. possible that the counting device is located in the region of a pliers head of the hand pliers. For a particular proposal of the invention, the counting device is integrated into hand levers of the hand pliers which also covers the integration of at least one module of the counting device at least partially into at least one hand lever.

It is possible that the hand levers of the hand pliers due to their large extension in longitudinal direction provide a large accommodating space in this direction. On the other hand, the hand levers usually perform a larger movement over the working stroke than e.g. the pliers jaws so that for sensing the distance of the hand levers for counting the number of passed working strokes it is possible to use a sensor device with a comparatively low precision of the measurements or to achieve a high measuring accuracy. It is also possible that two modules of the counting device are each located at sides of the hand levers facing towards each other or that the two modules are integrated into these sides or hand levers so that the two modules to a far extent approach each other at the end of the working stroke or also contact each other. On this basis it is in some cases possible to increase the number of applicable sensor types. It is also possible that at least one module protrudes from one of the hand levers towards the other hand lever in order to decrease the distance of the modules each associated with one of the hand levers. As an alternative or cumulative measure, it is also possible that the hand lever (or both hand levers) comprise a cranking, a web or protrusion towards the other hand levers into which (under a reduction of the distance to the other hand lever) the module is integrated. In an extreme case, it is also possible that over the part of the stroke or the whole working stroke of the hand levers the cranking, the web or protrusion and therewith also the module extends through a recess of the other hand lever. In this case, the other module is integrated into the other hand lever in the region of the recess and the two modules interact with each other for producing the measurement signal. Another advantage of the integration of the counting device into hand levers of the hand pliers can be that usually the pliers head is subjected to rougher conditions of use than the hand levers of the hand pliers so that here a counting device (which in some cases is sensitive) is not easily damaged. Furthermore, it is possible that the counting device is protected by the hand levers of the hand pliers when integrating the counting device into the same.

For a particular embodiment of this solution, it is possible that the hand levers are built in a plate design. In this case, the counting device (in particular at least one module of the same) is (at least partially) accommodated between the plates of the hand lever. This solution combines the advantage of the design of the hand levers in a plate design (in particular cost-efficient manufacturing; a stiff but nevertheless compact design and the option to form bearing lugs in the plates with bores of the plates or with bearing bolts held by the plates) with the provision of an accommodating space for the module of the counting device in a simple way between the plates and at the same time of protecting the module by the plates.

For another proposal of the invention, a module of the counting device is integrated into a cover of a hand lever made of plastic or at least partially covered by the cover of the hand lever made of plastic. This embodiment uses the finding that a measurement principle of the sensor is not (essentially) compromised by a cover made of plastic or a partial covering. Nevertheless, the cover made of plastic or the at least partial cover provides a protection of the module of the counting device. Furthermore, by the integration of the module of the counting device also a kind of block of the module is built in which single components of the module are fixed in their positions relatively to each other. It is possible that the counting device works autonomously. It is also possible that the counting device cooperates via contact-less connections with external devices for a power supply and/or a data transfer. For another proposal of the invention, the counting device comprises a port. It is possible that the port serves for the power supply during the use of the hand pliers. For an alternative or cumulative embodiment, it is possible that the port serves for reloading the accumulator. Furthermore, it is possible that via the port it is possible to change the operating conditions or setting of the counting device. It is also possible that the port is used as a data transfer device by which operating data of the hand pliers or also the actual counting state of the counting device (in some cases with additional information as the frequency of the passing of a working stroke at a working date, the date and time of the passing of a working stroke or other measurement values as actuating forces, crimping forces, crimping force-crimping displacement-progressions) is/are transferred.

It is possible that the display of a counting number and of information derived thereof is only provided by an external displaying device. For one embodiment of inventive hand pliers, a displaying device is provided at the hand pliers itself. By the displaying device it is possible to display the number of passed working strokes or an information dependent thereof. The information being dependent on the number of passed working strokes is e.g. the information if a threshold value for the number of passed working strokes has been reached.

Generally, different embodiments of the displaying device are possible. For one inventive proposal, the displaying device is built with at least one LED which e.g. dependent on the operating state (in particular by actuation/deactivation of the LED or operation of the LED with different colors) displays if a threshold for the number of the passed working strokes has been reached or if the hand pliers are ready for being operated or if instead a certification is required.

The evaluation of the result of the counting device can be done in any way. For one proposal of the invention, the counting device comprises a control unit. The control unit comprises control logic which on the basis of the counted working strokes performs an evaluation with respect to wear of the hand pliers, in particular of a die or the drive mechanism. Dependent on the result of this evaluation then the maintenance, repair or only a certification or examination is performed.

For a further development it is possible that a plurality of information is given to the user. For this purpose the control unit of the counting device comprises control logic which compares the number of working strokes registered by the counting device with a first threshold. When exceeding the first threshold, the control unit controls the displaying device for producing a first display. Furthermore, the number of working strokes registered by the counting device is compared with a second threshold (which deviates from the first threshold). When exceeding the second threshold, the control unit controls the displaying device for producing a second display. It is also possible that additionally also a comparison with a third, fourth, . . . threshold is performed for producing a third, fourth, . . . display. This can be explained on the basis of the following non-limiting example: It is possible that before the actual beginning of operation of the hand pliers the hand pliers have to pass some working strokes, e.g. within the frame of a quality control at the manufacturer. Accordingly, the first threshold might correlate with the number of these working strokes passed before the start of operation. When exceeding the first threshold by means of the first display it is possible to indicate that the hand pliers are ready for operation. If after N working strokes the use of the hand pliers has to be terminated or a certification or examination, a maintenance or an exchange of a die or another component has to be provided, a second threshold might be chosen corresponding to the number N. When exceeding the second threshold by means of the second display, it is indicated to the user that the operation of the hand pliers has to be terminated or a certification has to be provided. In the case that the user should not be surprised by this demand for terminating the operation, it is possible to define a third threshold which is smaller than the aforementioned second threshold (e.g. 5 or 10% smaller than the second threshold). When exceeding the third threshold, it is possible to indicate to the user by the third display that within short the termination of the operation of the hand pliers will be required and only a limited number of working strokes should still be passed by the hand pliers.

The different displays might be built by different colors of an LED, the control of different LEDs, the change from a permanent operation of an LED (e.g. as the third display) to a flashing operation of the same LED as the second display and the like.

For a further embodiment of the invention, the counting device comprises a reset-device. By the reset-device it is possible to reset the actual counting number for the working strokes to zero or to a given value. In order to mention a non-limiting example, the counting device might be used for providing that for avoiding excess wear of dies the dies are only used for a defined number of working strokes. If the dies are exchanged ahead of time or the dies are exchanged after having passed the predetermined maximal number of working strokes, it should be possible that the counting device is also used for a new couple of dies. This can be provided by resetting the actual counting number with the reset-device. Here, it is possible that the reset-device is actuated by a switch, button or sensor which is freely accessible at the hand pliers (e.g. at an inner side of a hand lever). In the case that it is of interest to avoid an unintended actuation of the reset-device, it might be advantageous if the reset-device is covered by a lid or flap or that the reset-device is located behind a protrusion or in a recess so that a free access to the reset-device is hindered. It is also possible that a reset-device is used which is only actuatable by a special tool or by an electrical reset signal. It is possible that the thresholds used for a comparison with the number of passed working strokes registered by the counting device are fixed, wherein for every type of hand pliers, any type of the used drive mechanism and/or any type of workpiece worked with the hand pliers different thresholds might be used.

For another embodiment, the invention proposes that the control unit comprises a counting device with control logic which determines the threshold dependent from operating parameters. If e.g. the actuating force or crimping force is sensed at the hand pliers, it is possible that the control unit considers a smaller threshold if during the working strokes a comparatively large actuating force or crimping force is present, whereas a larger threshold is used if during the working strokes comparatively small actuating forces or crimping forces are applied. Further possibly considered operating parameters might e.g. be (without a limitation to these) temperature conditions, the frequency of actuation, the type of dies used and the like.

The invention also proposes that the counting device is built with at least one (preferably two) module(s). These modules might provide a simple assembly and disassembly. Here, one module might be built with a transmitter of the sensor or with a permanent magnet, wherein the other module might comprise a receiver, a reed-contact and the like. By these modules it is also possible to provide that in a simple fashion a plurality of variants for the configuration of the hand pliers (namely hand pliers with counting device and hand pliers without counting device) can be provided. It is also possible that by the modular design of the counting device a simple retrofitting of given hand pliers with a counting device is made possible.

It is also possible that the counting device counts the passing of each working stroke, the arrival at a starting region or end region of the working stroke or of an end position of the working stroke and the like. However, it is also possible that the hand pliers comprises a working stroke which requires a plurality of successive stroke parts. For mentioning only non-limiting examples, hand pliers of this type might be built by cutting pliers according to patent DE 43 03 180 C2 or hand pliers for crimping fittings, tubes, cable shoes or similar tools according to patent DE 198 34 859 C2 or DE 199 63 097 C1 or crimping pliers according to DE 10 2008 005 472 B3. Here, in some cases the number of passed stroke parts is not meaningful for the bias of the components of the hand pliers because in a first stroke part of the working stroke the bias of the components is still small, whereas the bias increases with increasing number of executed stroke parts. In this case, it is possible that the control unit of the counting device comprises control logic which increases the registered number of counts only if a plurality of stroke parts or all of the stroke parts of the working stroke have been executed. It is also possible that the registered number of counts is only increased after having reached a defined end position of the working process. It is also possible that hand pliers of this type comprise a so called forced locking unit (cp. also the publications of the applicant mentioned in the present application, wherein a forced locking unit is used). By a forced locking unit the passing of all of the required stroke parts is made obligatorily or an opening movement of the hand pliers is only possible when reaching the defined end position of the working process and/or a temporal release of the hand levers is made possible after a part of the working stroke. Here, a latching pawl is only released for the opening movement of the hand levers after having run through all of the successive stroke parts or after having reached a defined end position of the working process. The release of a latching element of this type might for a detection of the release by a suitable sensor be used as an impulse for the increase of the registered count number.

Advantageous developments of the invention result from the claims, the description and the drawings. The advantages of features and of combinations of a plurality of features mentioned at the beginning of the description only serve as examples and may be used alternatively or cumulatively without the necessity of embodiments according to the invention having to obtain these advantages. Without changing the scope of protection as defined by the enclosed claims, the following applies with respect to the disclosure of the original application and the patent: further features may be taken from the drawings, in particular from the illustrated designs and the dimensions of a plurality of components with respect to one another as well as from their relative arrangement and their operative connection. The combination of features of different embodiments of the invention or of features of different claims independent of the chosen references of the claims is also possible, and it is motivated herewith. This also relates to features which are illustrated in separate drawings, or which are mentioned when describing them. These features may also be combined with features of different claims. Furthermore, it is possible that further embodiments of the invention do not have the features mentioned in the claims.

The number of the features mentioned in the claims and in the description is to be understood to cover this exact number and a greater number than the mentioned number without having to explicitly use the adverb "at least". For example, if an element is mentioned, this is to be understood such that there is exactly one element or there are two elements or more elements. Additional features may be added to these features, or these features may be the only features of the respective product.

The reference signs contained in the claims are not limiting the extent of the matter protected by the claims. Their sole function is to make the claims easier to understand.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
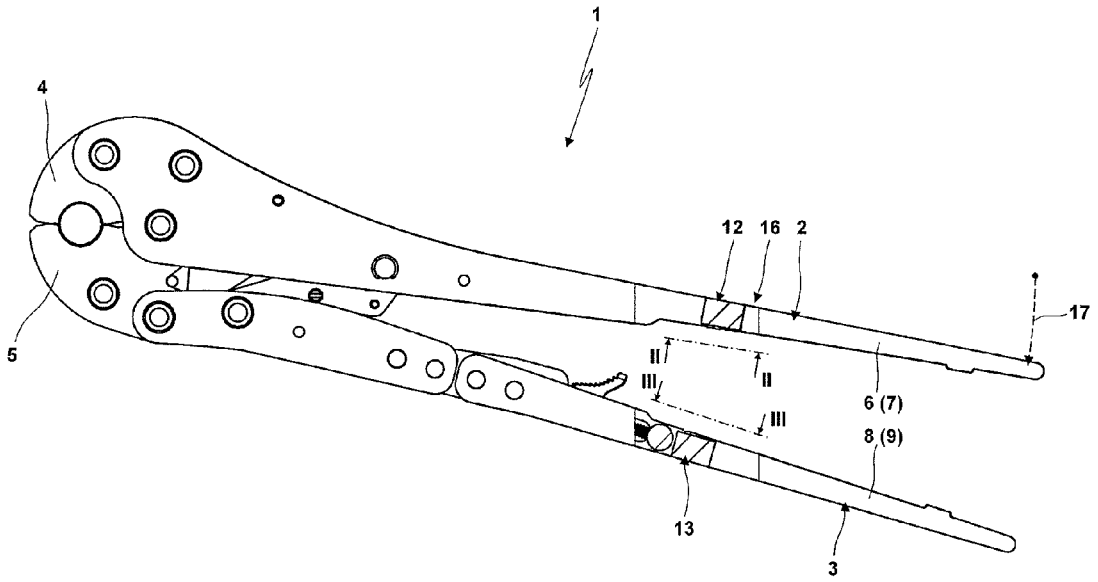
FIG. 1 shows inventive hand pliers in a partially cut plain view.

FIG. 1 shows as an example hand pliers 1, here embodied as crimping pliers for crimping tube connections as generally described in the publication DE 199 63 097 C1 and DE 103 46 241 B3 which are integrated into the disclosure of the present application.

Figure 2:
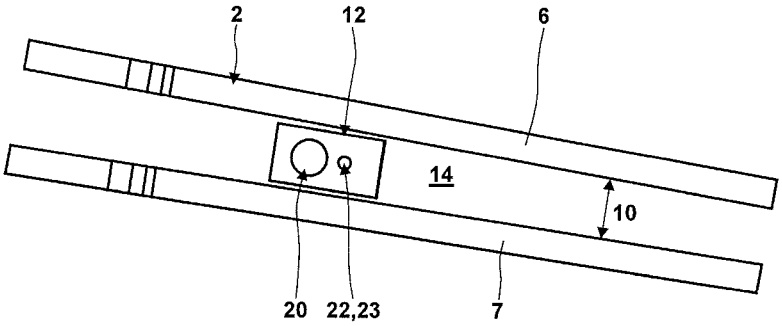
FIG. 2 shows a detailed view II-II of the hand pliers according to FIG. 1.
Figure 3:
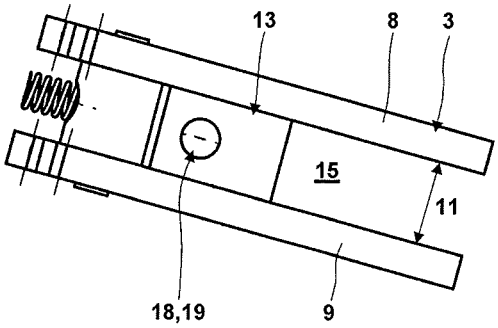
FIG. 3 shows a detailed view III-III of the hand pliers according to FIG. 1.

The actuation of the hand pliers 1 is provided by a pivoting movement of the hand levers 2, 3 towards each other over a working stroke 17 which coincides with the crimping of a workpiece between pliers jaws 4, 5. The hand levers 2, 3 each have a plate design with two plates 6, 7, respectively 8, 9, which have a distance 10, 11 in the region shown in FIGS. 2 and 3. In each of the regions of the hand levers 2, 3 a module 12, 13 is arranged. For the shown embodiment, the modules 12, 13 are integrated into the hand levers 2, 3, namely arranged in an intermediate space 14, 15 defined by the distance 10, 11. For this purpose, the modules 12, 13 have an extension which corresponds to the associated distance 10, 11 or which is smaller than the associated distance 10, 11. Also alternative options for an integration or for holding the modules 12, 13 at the base bodies of the hand levers 2, 3 are possible. It is e.g. possible that the modules 12, 13 are integrated into a recess of a base body of the hand levers 2, 3.

Figure 4:
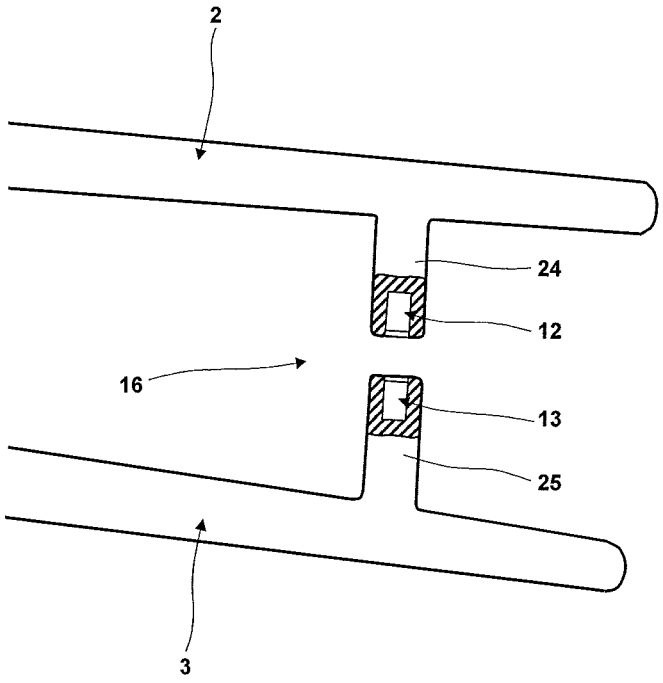
FIG. 4 shows in detail an end region of hand levers of inventive hand pliers.

A counting device 16 is built with the modules 12, 13. The counting device 16 counts the number of passed working strokes 17 of the hand levers 2, 3 towards each other for processing the workpiece. For the shown embodiment, the module 13 is built with a transmitter 18 which might e.g. be a permanent magnet 19. It is possible that the module 12 comprises a receiver 20. If the transmitter 18 is built with a permanent magnet 19, the receiver 20 is able to sense the magnetic field and its change over the working stroke 17. A sensor 21 is built with the transmitter 18 and the receiver 20. The sensor 21 senses the distance of the hand levers 2, 3 or senses that the distance of the hand levers 2, 3 goes below a minimum distance which triggers a counting impulse. Furthermore, a displaying device 22 (in particular an LED 23) is integrated into the module 12 which is visible for the user at the inner side of the hand lever 2. However, (deviating from the shown embodiment) is it also possible that the displaying device 22 is located in a side region or at the outer side of the hand lever 2 so that it is visible. For the embodiment shown in FIGS. 1 to 3 also at the end of the working stroke 17 the modules 12, 13 comprise a comparatively large distance so that it is required to use a sensor which is also able to trigger the signal used for the counting or a counting impulse for this distance. If it is intended to reduce the distance of the modules 12, 13, it is possible that in the region of the counting device at least one of the hand levers 2, 3 comprises a protrusion 24, 25 towards the other hand lever 3, 2 which supports the module 12, 13 or wherein the module 12, 13 is integrated (cp. FIG. 4).

Figure 5:
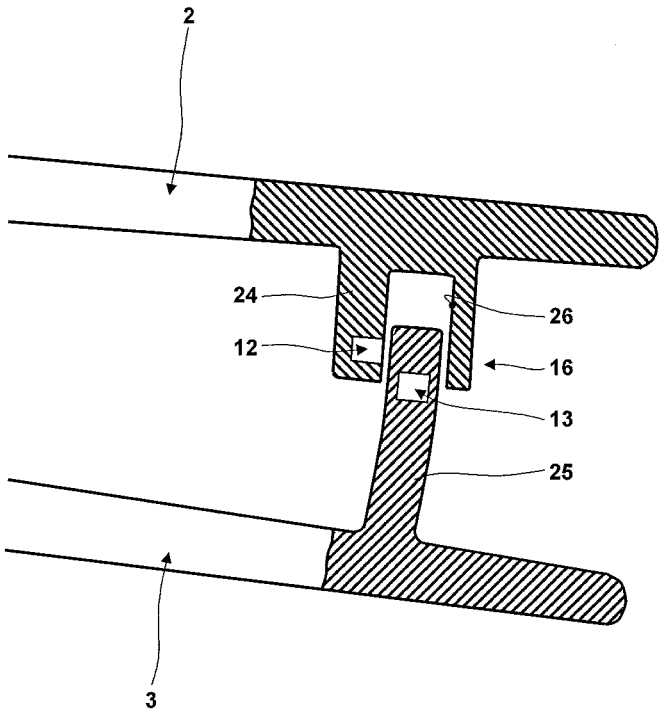
FIG. 5 shows in detail an end region of hand levers of inventive hand pliers.

It is also possible that according to FIG. 5 a protrusion 25 of a hand lever 3 extends into a recess 26 of a protrusion 24 of the other hand lever 2 or of the base body of the hand lever 2 itself (and in some cases also extends through to the other side). In this case, it is possible that the module 12 is located in a lateral limiting region of the recess 26 so that during the working stroke 17 the module 13 laterally passes the module 12 (in some cases with a very small distance). It is possible that for this embodiment the modules 12, 13 are additionally protected by the entry or accommodation of the protrusion 25 into or in the recess 26 of the protrusion 24. Differing from the shown embodiment, it is also possible that a plurality of modules, in particular a plurality of transmitters, is integrated into at least one of the protrusions 24, 25 which are then passed successively which might lead to a more exact sensing of the distance of the hand levers 2, 3 or to a sensing of the distances in a plurality of steps.

Figure 6:
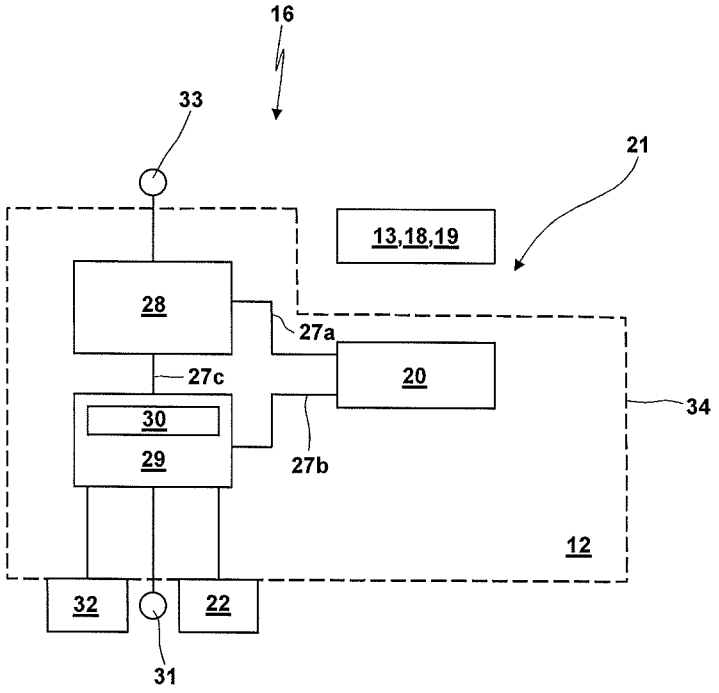
FIG. 6 schematically shows a counting device which might be used in inventive hand pliers.

FIG. 6 schematically shows the counting device 16 which is built with the two modules 12, 13. Here, the module 13 associated with the hand lever 3 is built with a permanent magnet 19 so that this module 13 does not require a power supply and a control device and does not receive or produce signals.

The module 12 associated with the hand lever 2 comprises the receiver 20 which is connected by wire connections 27 to a battery or an accumulator 28 or a control unit 29 which comprises suitable control logic 30. The control unit 29 is again connected to a displaying device 22 and/or a port 31 for an external power supply and/or for a data transfer and/or to a reset-device 32 for resetting the registered count number. The electrical power supply of the control unit 29 might be provided via the port 31 or by the accumulator or the battery 28. For the use of an accumulator 28 another port 33 might be provided for the first loading or reloading of the accumulator.

Preferably, a module 12, 13 comprises or both modules 12, 13 comprise an overall construction size of less than 8 $cm^3$, preferably less than 2 $cm^3$ and in particular less than 1 $cm^3$ and/or a maximal extension of 1 cm.

In FIG. 6 the module 12 is framed with a dashed line. It is possible that the module 12 is cast to a block 34.

It is possible that as the sensor 21 an infrared distance sensor is used. Furthermore, it is possible that a transfer between the modules 12, 13 of the counting device 16 and/or between the counting device 16 and an external monitoring device, displaying device, documenting device, storing device and/or evaluating device is provided by an infrared transfer device which might operate uni-directional or also bi-directional (e.g. for changing operating parameters of the counting device 16, for performing an initialization or performing a reset).

The inventive design is e.g. also usable in connection with hand pliers as distributed by the applicant under the identification CS 10, CSV 10 , CSV 10 LWL-MOST-POF, CSV 10 LWL-MOST, CSV 10 FAKRA, CS 11, AE, AE 24, CS 8, CK 90, CK 100, CS 30 STRATO, PHOTOVOLTAIK, CS 40, CS KTVR, CE, cable cutter SH or SCORA 2 (cp. brochure WEZAG: Werkzeuge für die professionelle Anwendung, document-No.: Cat. 10/11). These or other hand pliers of the present type for which the invention is usable are furthermore described in the documents of the applicant DE 35 12 157 C2, DE 37 08 727 C2, DE 37 33 358 C1, DE 40 23 337 C1, DE 40 26 332 C2, DE 40 39 435 C1, DE 43 03 180 C1, DE 44 27 553 C2, DE 196 10 899 C1, DE 296 20 856 U1, DE 197 13 580 C2, DE 197 09 639 A1, DE 197 53 436 C2, DE 297 12 879 U1, DE 198 02 287 C1, DE 198 07 737 C2, DE 298 03 336 U1, DE 198 32 884 C1, DE 198 34 859 C2, DE 199 24 086 C2, DE 199 24 087 C2, DE 199 63 097 C1, DE 100 56 900 C1, DE 101 32 413 C2, DE 101 40 270 B4, DE 102 42 345 B3, DE 103 46 241 B3, DE 10 2005 003 615 B3, DE 10 2005 003 617 B3, DE 10 2007 038 626 B3, DE 10 2007 001 235 B4, DE 10 2008 003 524 B4, DE 10 2008 007 303 B4, DE 10 2008 005 472 B3, DE 10 2008 012 011 B3, DE 10 2008 017 366 A1, DE 20 2008 003 703 U1, DE 10 2009 001 949 A1, EP 1 724 101 B1, EP 2 305 428 A1, EP 2 463 969 A2, EP 2 562 891 A1, EP 2 672 580 A1, EP 2 672 581 A1, EP 2 672 582 A1, EP 2 672 583 A1, EP 2 672 584 A1, EP 2 672 585 B1 and the post-published patent applications EP 2 826 598 A1, EP 2 905 848 A1 as well as the non-published patent application EP 14 177 831.6.

Many variations and modifications may be made to the preferred embodiments of the invention without departing substantially from the spirit and principles of the invention. All such modifications and variations are intended to be included herein within the scope of the present invention, as defined by the following claims.

I claim:

1. Hand pliers comprising a counting device for counting a number of passed working strokes wherein the counting device is built with a sensor which senses a distance or displacement of two components moved relatively to each other over the working stroke, wherein the counting device is built with a cast module into which:

a) a control unit,
b) at least a wire connection,
c) an electrical or electronical board,
d) a transmitter,
e) a receiver,
f) a displaying device,
g) a battery or an accumulator,
h) a port for a power supply and/or
i) a port for a data transfer
is/are integrated;

wherein a control unit or the control unit of the counting device comprises control logic which on the basis of a counted number of working strokes performs an evaluation of a wear of a die or a drive part of the hand pliers.

2. The hand pliers of claim 1, wherein the counting device is integrated into hand levers of the hand pliers.

3. The hand pliers of claim 2, wherein one of the hand levers is built in a plate design and the cast module is accommodated between plates of the hand lever.

4. The hand pliers of claim 2, wherein the cast module is integrated into a cover of one of the hand levers made of plastic or at least partially covered by the same.

5. The hand pliers of claim 1, wherein the counting device comprises a port.

6. The hand pliers of claim 1, wherein a displaying device for displaying the number of passed working strokes or an information dependent thereof is provided.

7. The hand pliers of claim 6, wherein the displaying device is built with a LED.

8. The hand pliers of claim 1, wherein the control unit of the counting device comprises control logic which compares the number of working strokes registered by the counting device with a threshold and when exceeding the threshold controls or actuates a displaying device.

9. The hand pliers of claim 8, wherein the control unit of the counting device comprises control logic which determines the threshold value dependent on other operating parameters of the hand pliers.

10. The hand pliers of claim 9, wherein the control unit of the counting device comprises control logic which a) compares the number of working strokes registered by the counting device with a first threshold and actuates or controls the displaying device for producing a first display when exceeding the first threshold and b) compares the number of working strokes registered by the counting device with a second threshold and actuates or controls the displaying device for producing a second display when exceeding the second threshold.

11. The hand pliers of claim 9, wherein the control unit of the counting device comprises control logic which a) compares the number of working strokes registered by the counting device with a threshold which corresponds to a number of calibrating strokes or working strokes of a quality control, b) compares the number of the working strokes registered by the counting device with a threshold which corresponds to a number of the maximal admissible working strokes and/or c) compares the number of working strokes registered by the counting device with a threshold which correlates with the upcoming arrival at the number of the maximal admissible working strokes.

12. The hand pliers of claim 8, wherein the control unit of the counting device comprises control logic which a) compares the number of working strokes registered by the counting device with a first threshold and actuates or controls the displaying device for producing a first display when exceeding the first threshold and b) compares the number of working strokes registered by the counting device with a second threshold and actuates or controls the displaying device for producing a second display when exceeding the second threshold.

13. The hand pliers of claim 12, wherein the control unit of the counting device comprises control logic which a) compares the number of working strokes registered by the counting device with a threshold which corresponds to a number of calibrating strokes or working strokes of a quality control, b) compares the number of the working strokes registered by the counting device with a threshold which corresponds to a number of the maximal admissible working strokes and/or c) compares the number of working strokes registered by the counting device with a threshold which correlates with the upcoming arrival at the number of the maximal admissible working strokes.

14. The hand pliers of claim 8, wherein the control unit of the counting device comprises control logic which a) compares the number of working strokes registered by the counting device with a threshold which corresponds to a number of calibrating strokes or working strokes of a quality control, b) compares the number of the working strokes registered by the counting device with a threshold which corresponds to a number of the maximal admissible working strokes and/or c) compares the number of working strokes registered by the counting device with a threshold which correlates with the upcoming arrival at the number of the maximal admissible working strokes.

15. The hand pliers of claim 1, wherein the counting device comprises a reset-device.

16. The hand pliers of claim 1, wherein the cast module builds an assembly-module, a disassembly-module and/or a retrofit module.

17. The hand pliers of claim 1, wherein the control unit of the counting device comprises control logic which increases the registered count number a) for a working stroke requiring a plurality of successive stroke parts only after having passed all of the successive stroke parts or b) only after having reached a defined end position of the working process.

* * * * *